US007459658B2

(12) United States Patent
Hays et al.

(10) Patent No.: US 7,459,658 B2
(45) Date of Patent: Dec. 2, 2008

(54) DRUM HEATER SYSTEMS AND METHODS

(75) Inventors: Andrew W. Hays, Fairport, NY (US); Barry Daniel Reeves, Lake Oswego, OR (US); William Bruce Weaver, Sherwood, OR (US); Scott Phillips, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 260 days.

(21) Appl. No.: 11/214,913

(22) Filed: Aug. 31, 2005

(65) Prior Publication Data

US 2007/0045295 A1 Mar. 1, 2007

(51) Int. Cl.
*H05B 3/16* (2006.01)
*G03G 15/20* (2006.01)

(52) U.S. Cl. ..... 219/469; 219/216; 219/470; 219/619; 399/331; 399/333

(58) Field of Classification Search ..... 219/216, 219/469–471, 534, 542, 544, 548, 619; 399/328–338
See application file for complete search history.

(56) References Cited

U.S. PATENT DOCUMENTS 3,417,226 A * 12/1968 Thomiszer ..... 219/216
3,688,082 A * 8/1972 Crane et al. ..... 219/216
4,498,757 A * 2/1985 Lance et al. ..... 399/332
5,401,937 A * 3/1995 Nagano ..... 219/544
6,670,588 B2 * 12/2003 Kitano et al. ..... 219/619
6,713,728 B1 3/2004 Justice et al.
2002/0031381 A1 * 3/2002 Miyahara et al. ..... 399/330

* cited by examiner

*Primary Examiner*—Philip H Leung
(74) *Attorney, Agent, or Firm*—Oliff & Berridge, PLC.

(57) ABSTRACT

An internal heating system for an image transfer drum is disclosed that can include a box having a plurality of sides, an open side facing the drum and a heater element. The box can have small gaps between it and the internal drum surface to maximize thermal efficiency of the internal heating system. The heater element can include first and second support structures that are disposed on a central support structure, the first support structure having an end connector at one side away from the second support structure. The heater system can also include at least two circuits, two channels and a relay switch, with the relay switch operating to switch the circuits into a series or parallel electrical configuration.

27 Claims, 7 Drawing Sheets

DRUM HEATER SYSTEMS AND METHODS

BACKGROUND

Some printing systems use a heated drum or roller system to form an image on a target media, such as paper. For example, to from an image by laser printing, heated rollers can be used to create a hot nip in a laser printer fuser. In an offset solid ink printing process, a heated drum may be used to support an entire image prior to an image transfer onto a target media. Such heated roller systems can maintain a temperature of the ink on their surface in a viscoelastic state which allows the ink to better spread and penetrate into the target media during transfer. Such a process can improve the ultimate print quality by, for example, increasing solid fill density, decreasing ink layer thickness, and increasing the durability of the prints.

Related art drum heating for solid ink-jet printers has been accomplished by using external quartz halogen lamps that are mounted in reflector assemblies. More recently, an internal mica/wire based drum heater has been use for drum heating, as describe in, for example, U.S. Pat. No. 6,713,728, which is hereby incorporated by reference in its entirety. However, such offset solid ink systems face a number of thermal challenges. For example, the challenges can include increasing an operational lifetime of the heating element, maintaining a uniform imaging drum temperature and achieving a fast warm-up rate. Further, an image drum cooling system may be required to cool the drum when, for example, printing images with high ink coverage. Accordingly, the ability to maintain a consistent drum temperature is required to control the properties of the ink for optimum printing quality.

SUMMARY

In printing systems, a heating architecture that minimizes leakage of energy, such as hot air, and that therefore efficiently conserves thermal energy is desirable. For example, an "oven style" heater architecture that fits tightly into the image drum with minimal gaps between the heater structure and the internal drum surface can reduce an amount of heat loss. Further, because heater elements can operate at high temperatures, such as approximately 750° C.-850° C., hot air may leak out of the drum and damage surrounding portions of a printer. Such energy losses also cause the drum operation to become inefficient by wasting energy and increasing drum warm up rates.

In accordance with the systems and methods of this disclosure, the gap space between the oven-style heater, such as wall of the heater structure, and the internal drum surface can be significantly reduced, and thereby maximize thermal efficiency by minimizing hot air leakage from the imaging drum. For example, the systems and methods of this disclosure can have a gap space between the oven-style heater and the internal drum surface of approximately 1 to 5 mm.

Additionally, when heater elements are used in the drum, flicker can occur when turning the heating elements on and off. Flicker may cause other devices on a shared circuit to receive variable input voltage. In the case of incandescent lighting, this voltage input variation can cause objectionable cyclic dimming of the light. Thus, for customer satisfaction and regulatory reasons, it is required to reduce and control flicker to meet regulatory requirements. Thus, the systems and method of this disclosure may prevent or reduce the problems discussed above by incorporating multiple small heater elements that still provide the required imaging drum thermal control and rapid warm up rate, while being controllably turned on and off sequentially or in sets without causing flicker.

In accordance with the systems and methods of this disclosure, the drum heater system may be controlled through one or more independently controlled heater channels. In various exemplary embodiments of this disclosure, a heating system may independently sense and control heating on one end of the drum and/or the other end of the drum. This configuration can maintain a uniform drum temperature on both ends of the imaging drum even though the heat input from the ink is unbalanced. Other components of the drum thermal control system may include a cooling fan, sensors and ducting to control cooling air to help uniformly control the drum temperature. To maintain a uniform drum temperature around the circumference of the imaging drum, the drum can be slowly rotated or jogged during heating so that the heat from the heater is applied evenly to the entire drum surface.

Some related art drum heaters are not energy efficient because of the problems discussed above. For example, related art drum heaters, e.g., non-oven type drum heaters, may cause the drum heater to draw excessive power in order to maintain the drum at a specific temperature. In particular, quartz halogen lamps are expensive and have a high in-rush current. The related art drum heater may also require more power and time to achieve the desired temperature. The ability to rapidly and uniformly heat and cool the imaging surface should be performed in an efficient manner. Thus, there is a need for drum heater systems and methods that are more efficient than the related art drum heaters.

In accordance with the systems and methods of this disclosure, a drum heater may be mounted internally and permanently fixed within the drum assembly. Such stationary internally mounted heater oven architectures may be used for a spinning drum. The heater oven can also include, for example, heater elements and mounting hardware, reflector/radiator assembly, an insulative wall, support structure and electrical connections. The drum heater can be partitioned into multiple sections made out of a refractory material, such as mica, and short heater elements can be mounted in each section. Such oven-style heaters are very compact and can provide good protection for heater element wires because a separation between the heating zone and cooling zone can be maintained.

In view of the above, an oven-style heating system for an image transfer drum may include a heater box having multiple sides. The heater box can be configured to include, for example, three to five sides along with at least one open side facing an internal part of the image transfer drum. The walls of the heater oven may be positioned so that only a small gap exists between the walls of the oven and the internal drum surface. For example, the gap may be approximately 2 to 3 mm. Such a small gap maximizes the efficiency of the heater system by minimizing energy loss, such as the escape of heated air.

The heater element inside the heater box of the oven-style heating system may include a support structure, an electrical wire wound in a coil around the support structure and electrical terminals extending away from the support structure. The electrical terminal can be connected to the coil by a fastener. By way of example, the support structure can be a rod.

Additionally, wire loops may be formed using dead turns of an actual heater resistance wire element to suspend the heater element internal support structure. The dead turns are the additional end loops of the heater resistance wire that are not used for heating. This configuration can prevent or reduce typical stresses that cause failures in support structures. This stress could be induced by printer shock and vibrations induced by the printer, user or during transportation. Additionally, the load path into the tube may be removed from a sensitive region on the tube that has a large quantity of surface flaws and failure initiation points, such as on the cut ends of the support tube. This configuration can also eliminate the need for costly secondary operations or treatments applied to the ends of the support element. Using dead turns of the element wire to provide the low stress support interface is extremely low cost because no additional parts or processes are required.

The support coils can be a redundant termination of the heater element that can improve mechanical and electrical reliability. This configuration may allow the support structure to float while still controlling the placement of the electrical filaments. As a result, the support rod does not become axially loaded during thermal expansion while in use. The support loops may also allow the electrical termination to be misaligned without causing stress to the heater system.

When electrical control wires are attached to both ends of each heater element and some of the wires run the length of the oven, a broken heater element can be difficult or impossible to replace in the event of a failure, unless the entire drum assembly is replaced. Some electrical connections are made to both ends of each heater via riveting. Subsequent removal of the individual heating elements is impossible since the endbells are permanently fixed to the drum. Thus, there is a need for drum heater systems and methods that allow easy removal of the heating elements when there is a failure.

Long heater elements that have both left and right heaters on a single element can be included in a drum heater system instead of short individual heater elements. The heater may be single-ended meaning that all electrical connections are established at one end of the heater. This configuration may enable extraction of a failed element through the endbell spokes without difficulty. This is a more cost effective design as the entire drum assembly does not need to be replaced in the event of a heater element failure. The long element may be configured using two coaxial refractory support tubes that are relatively inexpensive. Two heater coils may be externally mounted at opposite ends of the tube assembly and the leads may be returned to a single end via the internal tubing paths. The electrical wires may be terminated in a cap that serves both as a structural connector to the heater and the electrical connector to the power heater system. The cap may maintain the thermal integrity of the oven. A tool may be used to retract and insert the heater element.

In accordance with the systems and methods of this disclosure, a heater element may be positioned inside the heater box that includes at least first and second support structures, the first support structure being larger than the second support structure. Electrical lines may be disposed along the first and second support structures, and a coil may be formed around the first and second support structures. A first and second end connector can be included on ends of the first support structure, with the electrical lines terminating in only the second connector.

In various alternative embodiments, a highly reflective reflector may be placed behind the heater elements to reflect thermal energy towards the inside of the imaging drum. Alternately, a heater oven with a low mass inefficient reflective thermal shield can also provide efficient heat transfer to the inside of the image drum by re-radiating heat. The selection of the proper reflector or radiator depends on the design constraints and requirements.

The oven style drum heater may occupy a relatively small section internal to the drum or the inside surface area of the drum so that a larger portion of the internal drum surface is available for convective cooling from the drum cooling fan. Accordingly, thermal gradient management can be improved because the heat is contained inside of the oven and is not immediately removed when the drum fan is turned on.

An oven-style heater system may also include at least two circuits, two channels and a relay switch. The relay switch can operate to switch circuits into a series or parallel configuration to operate the heater elements.

BRIEF DESCRIPTION OF THE DRAWINGS

Various exemplary embodiments of the systems and methods according to the invention will be described in detail, with reference to the following figures, wherein.

DETAILED DESCRIPTION OF EMBODIMENTS

Figure 1:
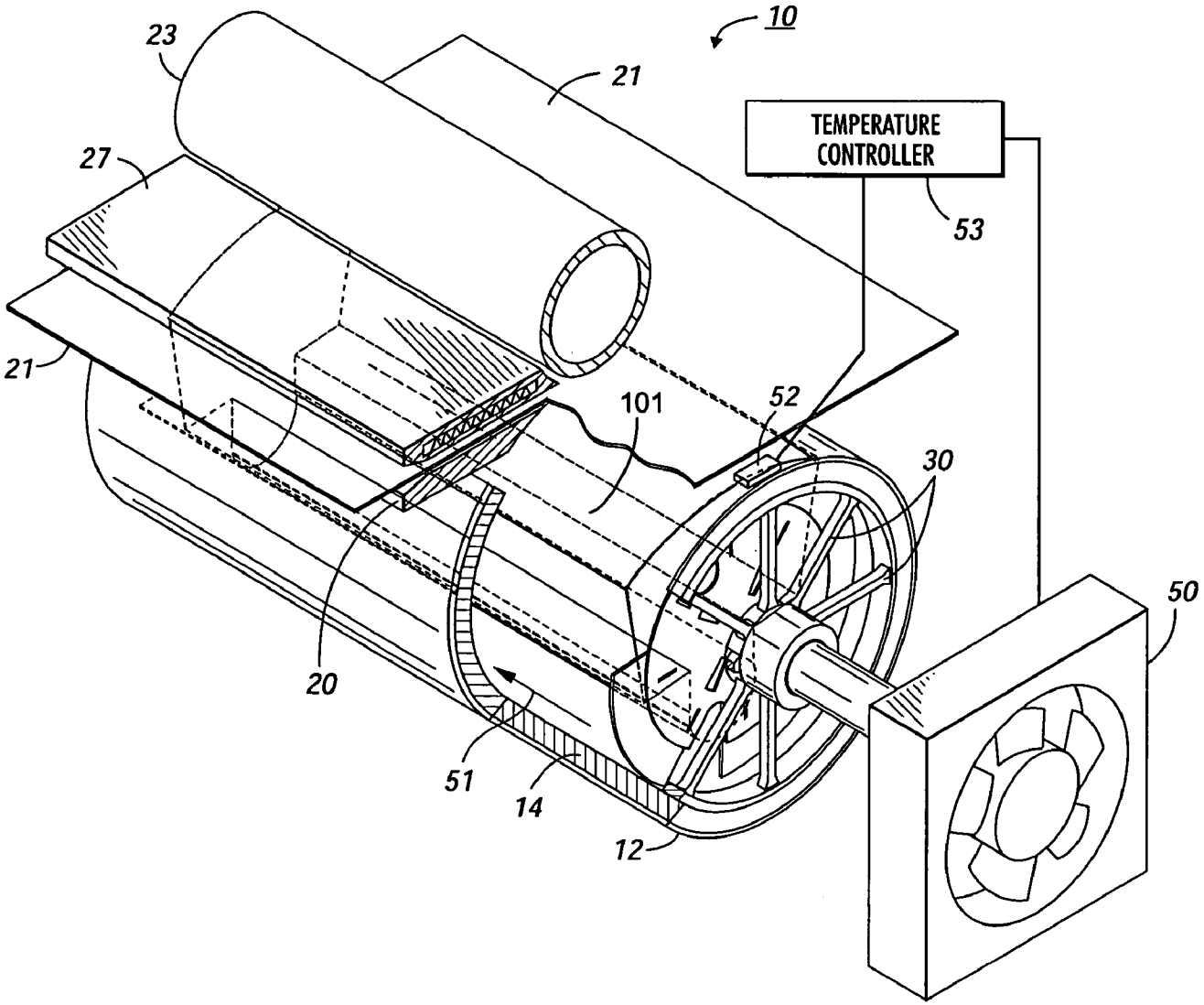
FIG. 1 is an exemplary diagram of a drum system of an imaging system.

FIG. 1 is a diagram of an exemplary drum system 10 of an imaging system. The drum system 10 can include an intermediate transfer surface 12 that is supported on a drum 14, a substrate guide 20, a roller 23, and a preheater plate 27. The drum system 10 can further include an oven-type heater system 101 that is positioned within the drum 14. During operation, a substrate 21, such as a piece of paper, can be passed between the substrate guide 20 and the preheater 27 to the intermediate transfer surface 12. The intermediate transfer surface 12 can be heated by the oven-type heater system 101 contained within the drum 14 to maintain a temperature during operation. A pattern on the intermediate transfer surface 12 can then be transferred from the intermediate transfer surface 12 to the substrate 21 to form an image on the substrate 21.

The exemplary drum system can also include a fan 50, a temperature sensor 52, and a temperature controller 53. As shown, the fan 50 and temperature sensor 52, can be coupled to the temperature controller 53. A fan 50 may be used to control the temperature of the drum 14. The fan 50 may blow air through the drum 14 in the direction indicated by the arrow 51. The preheater 27 may be set to a predetermined operating temperature by any conventional thermostatic device. The temperature sensor 52 can sense a drum temperature and send the sensed temperature to the temperature controller 53. Of course, more than one sensor may be used in the system, and therefore the temperature controller 53 can receive drum temperatures at different locations of the drum. Based on the sensed temperature information, the temperature controller 53 may control the heating system and/or the fan 50.

Figure 2:
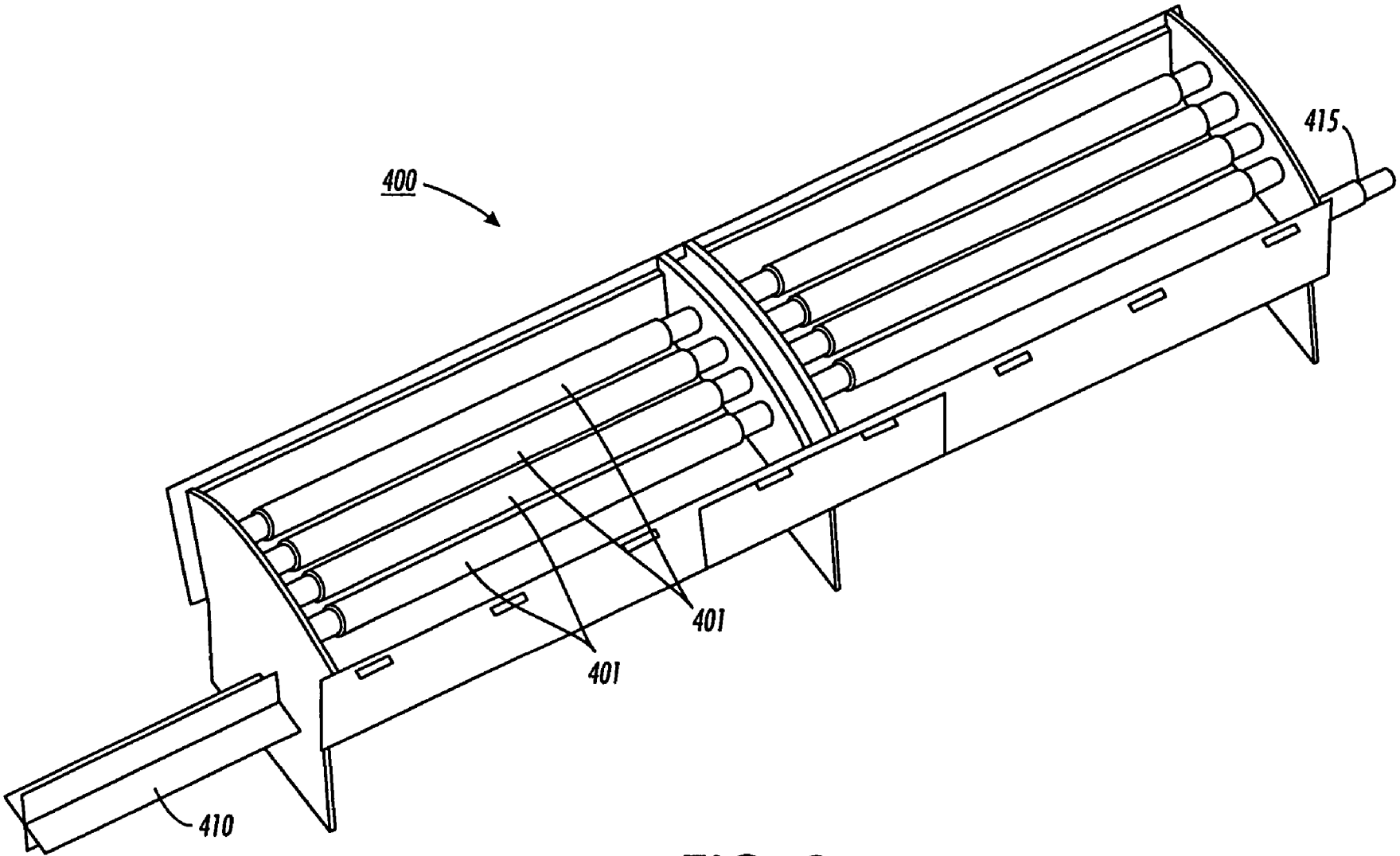
FIG. 2 is an exemplary diagram of an oven-type heater system that may be used in the drum.

FIG. 2 is an exemplary diagram of an oven-type heater system 400 that can be used in the drum 14 shown in FIG. 1. As shown in FIG. 2, the heater system 400 can include heater elements 401 that may be resistive wire coils externally supported by a support structure or internally supported by the support structure. The support structure may be, for example, a quartz tube or rod. It should be appreciated that the support structure can also be constructed of any refractory material. For example, mica can be used as the support structure provided the temperature of the wire coils 401 is below the service limit of the mica. It should also be appreciated that the heater elements 401 do not have to be wire coils, and that they are shown in FIG. 2 for exemplary reasons only. The wire coils 401 may be woven on a board as in a kitchen toaster or configured in any number of common ways to achieve the desired power and footprint.

The heater elements 401 in FIG. 2 may be, for example, 150 W heater elements, and the length of the heater elements 401 can be such to permit the elements to fit into receiving sections that are half of the drum length. By way of example, the heater system 400 in FIG. 2 can include a fused silica support tube with an outer diameter of 6.1 mm. A heater coil fabricated out of Kanthal AF or Nichrome 80 may be slid over the tube. It should be appreciated that any suitable alloy material could be used for the heater coils. Electrical terminals may then be crimped or welded onto the last few coils of the resistive wire. An electrical sub-channel may be formed by using a pair of the elements in series. The sub-channel may be paired with another sub-channel and mounted on either the left or right side of the drum to form a primary electrical channel. The other primary channel may be located at the opposite end.

Figure 3A:
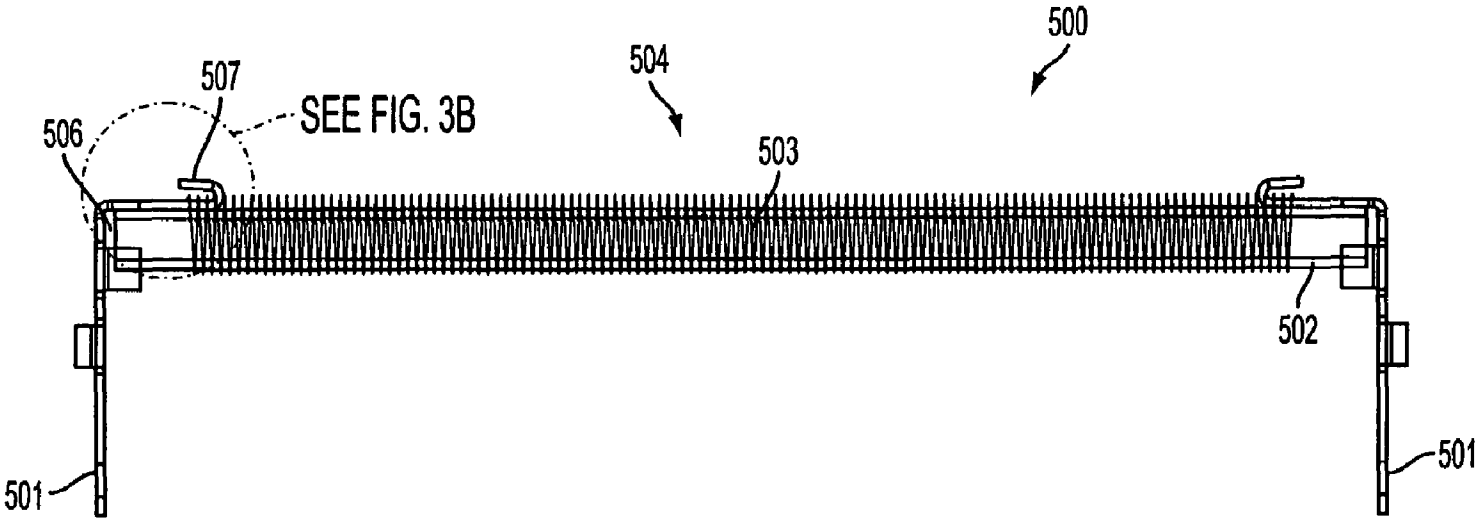
FIGS. 3A-B are exemplary diagrams of a heater element that may be used in the oven-type heater system of FIG. 2.
Figure 3B:
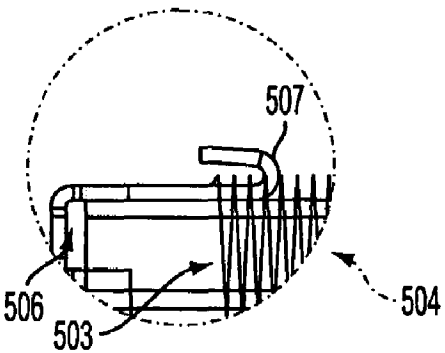

FIGS. 3A-B show an exemplary diagram of a heater element that may be used in the oven-type heater system of FIG. 2. The heater element 500 can include terminals 501, a rod or tube 502 as the support structure, and a resistive wire 503 that forms a coil 504. The terminals 501 may be connected to a power supply so that heat can be generated by passing electrical current through the wire 503 wound in a coil 504 around the support rod or tube 502. Because the coil 504 may be unable to support itself and become unstable at the high temperatures (e.g., heat generated during high power in small volume applications), the heater element 500 may be supported internally by the support rod or tube 502 allowing gravity to stabilize the turns of the coil 504 around the support rod or tube 502. By using such an internal support structure, a hot air pocket is not trapped around the coil 504 to elevate its temperature and possibly accelerate a failure.

Power may be transferred to the coil 504 via terminals 501 located at each end of the heater element 500. The terminals 501 can have structure on both sides that allow a simplified alignment, and that provide lateral support and stability to the overall assembly prior to installation. The actual electrical connection of the terminals 501 to the resistance wire 503 may be via a fastener 507, such as a crimp, weld or combination of thereof. As shown in greater detail in FIG. 3B, the fastener 507 may be formed to have a U-shaped end in contact with the coil 504. By creating an extra loop electrically shorted at each end (or multiple loops) of the coil 504, additional support for the heater element 500 can be provided. If the extra support loops are shorted at each end, no current or heat is generated within the support. A gap 506 may be formed to permit thermal expansion of the support 502.

The end of the support rod or tube 502 may be passed through the coil 504 during assembly either before or after the fastening process. The coil 504 may be positioned beyond an end of the support rod or tube 502, as discussed above. Using this configuration, a mechanical load path from the electrical terminals 501 into the support rod or tube 502 may be reduced or eliminated. Removing the mechanical load path also reduces or eliminates the possibility of a failure due to stress concentrations caused by cracks or sharp edges at the end of the support tube. This configuration may reduce the stress born by a fragile portion of the support rod or tube 502. By adjusting a relationship between a diameter of the coil 504 and the support rod or tube 502, a clearance may be established between an inner wire diameter and an outer tube diameter to create a misalignment between the terminals 501 without increasing the stress. The stress may occur when the loops of the coil 504 are allowed to flex in the heater element 500. The coil 504 may be stretched over the support rod or tube 502 to form a gap between the terminal 501 and the end of the support rod or tube 502. The gap may compensate for thermal expansion, provide a clearance during misalignment, and decouple structural loads that may have been passed into the support rod or tube 502, thus reducing failure of either the support rod or tube 502 and the heater element 500.

Referring back to FIG. 2, a mica support structure or mica box can be used in the heating system 400 as the support structure and as insulation. The terminals 501 may be fastened to the ends of the mica box and the electrical connections using, for example, rivets. A mica wall may also separate right and left channels into individual sub-ovens to prevent hot air and infrared radiation from crossing from one side to the other. The ends of the individual ovens may be extended down to a support structure. Structure within the ends of the mica box may provide wire guides to prevent the wires from contacting the revolving surface of the drum.

The bottom and sides of the mica box that are radiated directly by the infrared energy discharged from the heating element should be protected to prevent the bottom and sides from blistering and deforming from the heat. A reflector or insulator made from a thin piece of stainless steel or other suitable reflective material can be used as a barrier to prevent or reduce the blistering or deforming. During a cold start warm-up, the heater elements may be energized for an extended period of time. Some of the energy may be transferred directly to the drum in the form of radiation, and some of the energy may be transferred directly via convection. The radiation that does not transfer directly to the inner surface of the drum may strike the reflector or insulator. Some of the radiation may be reflected back to the drum. The reflectivity of stainless steel is not particularly high and a significant portion of the photons may be absorbed into the metal and converted into heat. Since the mica box and air around the stainless steel create a very good insulation barrier, the metal heats to an appreciable temperature (e.g., 400° C.). The reflector can re-radiate and the energy can then travel back towards the inner drum surfaces and transfer heat to the air through convection. This process is enabled by the high melting point of stainless steel.

As shown in FIG. 2, the mica oven may be supported by a cross-piece 410 that runs along the axis of the drum. For example, one end of the cross-piece 410 includes a bearing pin 415 that may fit into a bushing in one endbell of the drum 14. The other end of the cross-piece 410 may protrude out of the drum 14 through endbell 30 and be held stationary so that the heater element is positioned upright with the heater elements facing up at a twelve o'clock position. This position is disclosed for exemplary reasons only and it should be appreciated that any position may be used besides the twelve o'clock position. In operation, the drum 14 can rotate about the heater with the bearing pin 415 being used as a fastener to hold the heater system into position.

Drum 14 cooling may be achieved by passing air through the interior of the drum 14. The drum heater system can also include support baffles or other structures external to the oven that can enhance drum 14 cooling. The baffles may force cooling air against the surface of the drum 14. A velocity component of the air from the baffles may be normal to the surface of the drum 14, thus increasing the heat transfer rate associated with the cooling air mass.

Another alternative embodiment may include heater elements and a controller that deliver more heat to one location of the drum than another. For example, because the ends of the drum tend to be cooler than the middle of the drum, the heater elements can be configured to dissipate more heat towards the ends of the drum 14.

Moreover, an embodiment may use a grounded grid to cover the top of the oven with a grounded grid that allows hot air and most of the radiation to be released. The grounded grid can be included as a safety element, and is not needed for operation. For example, the grounded grid can protect a user from being shocked if a heating coil became broken or disconnected, and came into contact with the ungrounded drum. If present, the grounded grid can be positioned, for example, 5 mm away from the heater elements.

The drum heaters can also include channels that control the heating of the drum. In various exemplary embodiments of this disclosure, a heating system may independently control heating on one side of the drum 14 and/or the other side of the drum 14. By using this control process, the drum surface, e.g., various zones along the drum surface, can be more uniformly heated. The fan 50 and sensor 52 shown in FIG. 1 may be used to help control the drum heat uniformity.

Figure 4A:
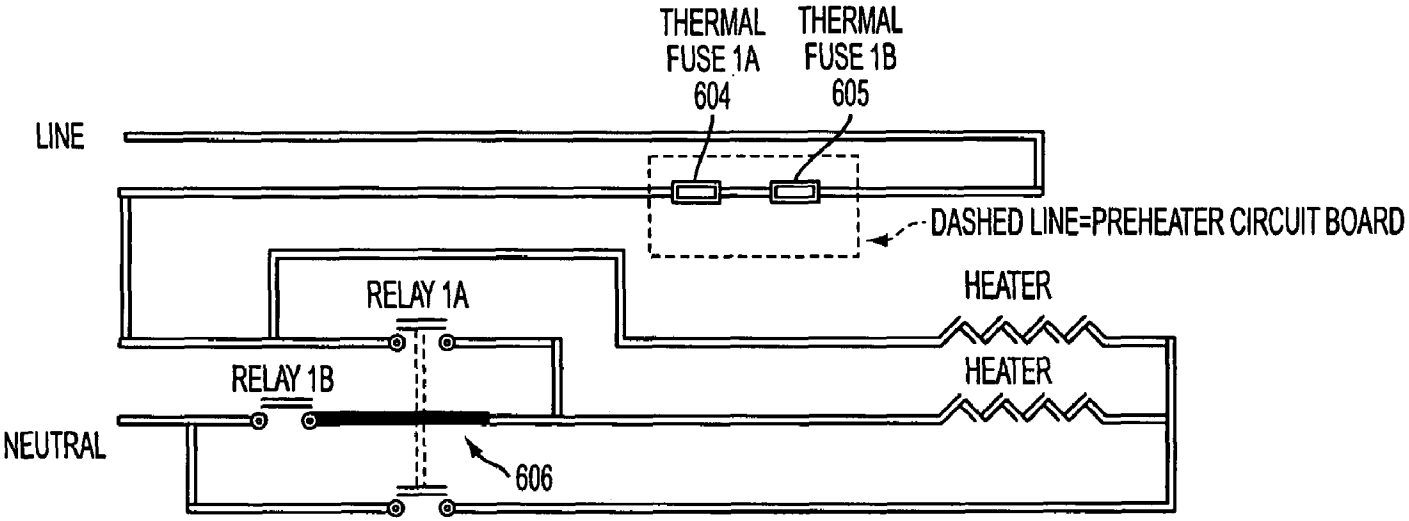
FIGS. 4A-B are exemplary diagrams of thermal cutout circuitries that may be used for a heater system.
Figure 4B:
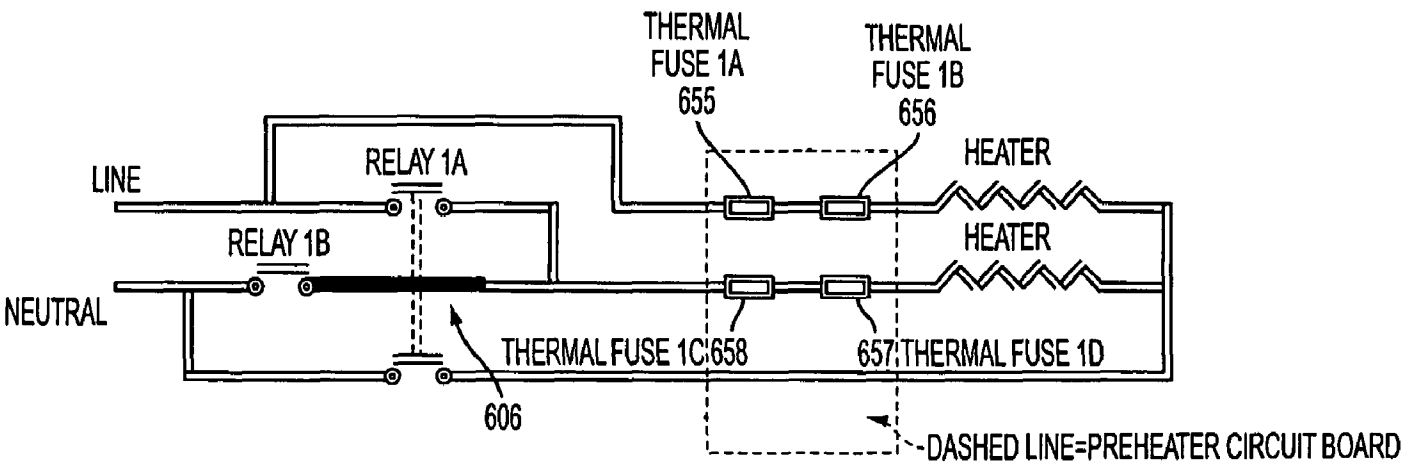

FIGS. 4A-B are exemplary diagrams of thermal safety cutout circuitries that may be used with the heater systems. The thermal cutouts 604, 605, 655, 656, 657 and 658 can be used for safety reasons. Two primary channels, e.g., left and right, may be used. Each circuit shown in the figures can corresponds to one primary channel. As shown in FIG. 4A, a line voltage may be directed above the drum in two channels. The thermal cutouts 604 and 605 can be positioned in series for the primary channel and, as described in greater detail below, may be placed above the corresponding heater circuit. Further, while shown with two, any number of thermal cutouts may be used. The line voltage may then be returned to the power supply or other power management circuit board where a relay 606 switches the heater circuits into a series or parallel configuration. As shown in FIG. 4B, thermal cutouts 655-658 can be placed on the primary channel. The thermal cutouts 655-658 can again be located above corresponding heater elements. This configuration may result in using four fuses 655-658 (two fuses configured in series) when the heater element is configured in the 230-volt configuration. In both FIGS. 4A and 4B, the relay 606 operates to switch the heater circuits into series or parallel configuration.

As described above, the thermal fuses or cutouts 604, 605, 655, 656, 657 and 658 can be positioned adjacent the heater circuit to sense an excessive heating condition. For example the thermal cutouts can be located on or in the substrate guide 20, shown in FIG. 1. By locating the cutouts in close thermal proximity to the imaging drum 14, the thermal cutouts can sense an excessive heat condition and act to electrically disconnect the heating element.

Figure 5:
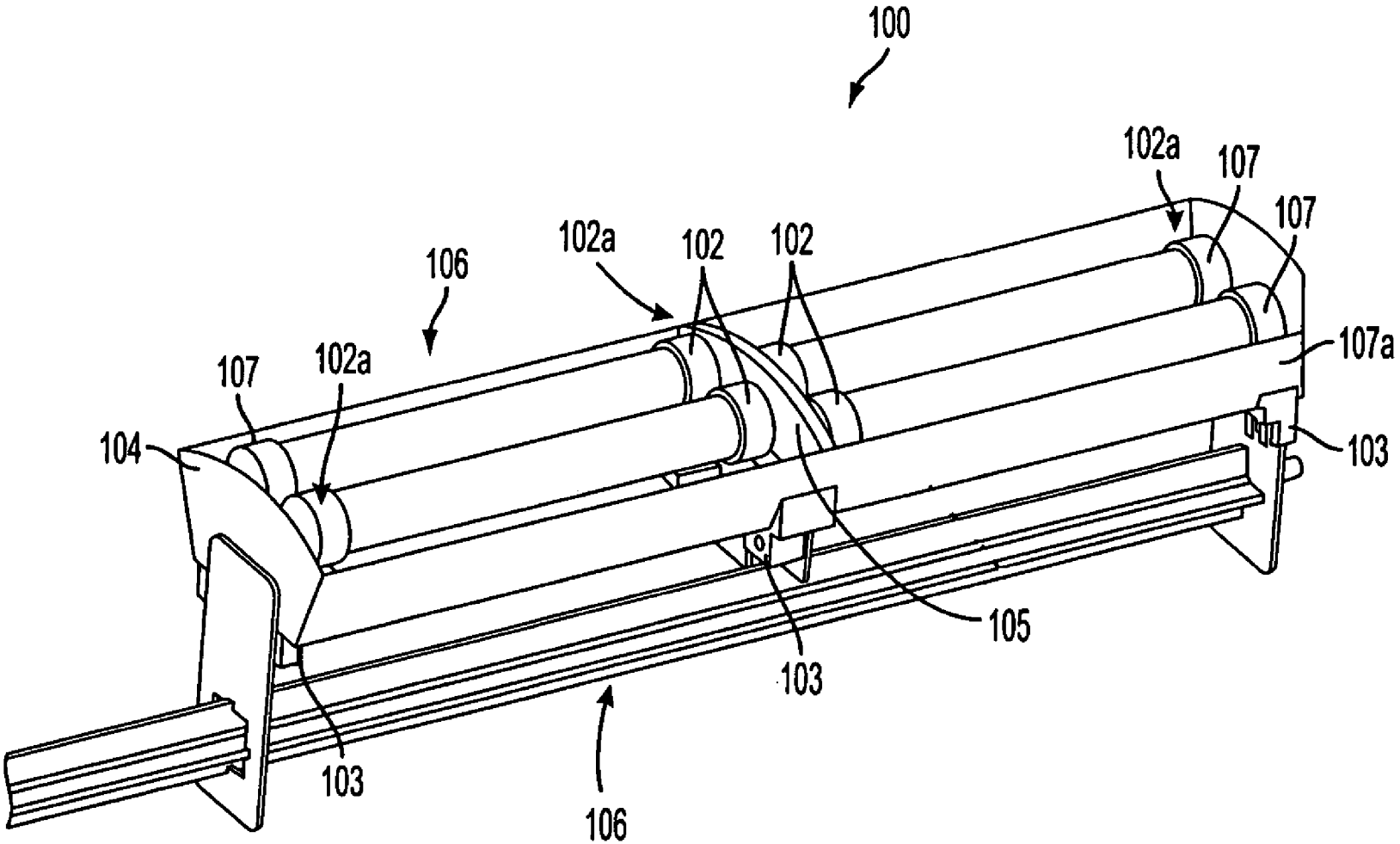
FIG. 5 is an exemplary diagram of a second oven-style heater system.

FIG. 5 is an exemplary diagram of a second exemplary oven-style heater system. As shown in FIG. 5, the heater system 100 may be an internally mounted heater oven used in a spinning drum. The heater system 100 may include heater elements 102, mounting hardware 103, reflector/radiator assembly 104, an insulative wall 105, support structure 106 and electrical connections 107. The heater system 100 can also include four heater elements 102. It should be appreciated that four heater elements 102 are shown for exemplary reasons only and that any number of heater elements can be used. The electrical connections 107 can be made at both ends 102*a* of each heater element 102.

As shown in FIG. 5, the alternative embodiment may use a reflector made of highly reflective material, such as anodized aluminum instead of mica and stainless steel. Since the reflectivity of anodized aluminum is much higher than the reflectivity for stainless steel, the majority of photons are reflected back to the inner drum surface. Thus, the efficiency of a highly reflective surface in some cases may be better than an inefficient reflector that is insulated. The use of a highly reflective surface does not preclude the use of an insulation used in conjunction with it to further improve its overall efficiency.

In FIGS. 2 and 5, if rivets are used with the electrical connections 107, a subsequent removal of the individual heater elements 102 may be impossible since the endbells are permanently fixed to the drum. Thus, the heater element 200 shown in FIG. 6 may be used to simplify the removal process.

Figure 6:
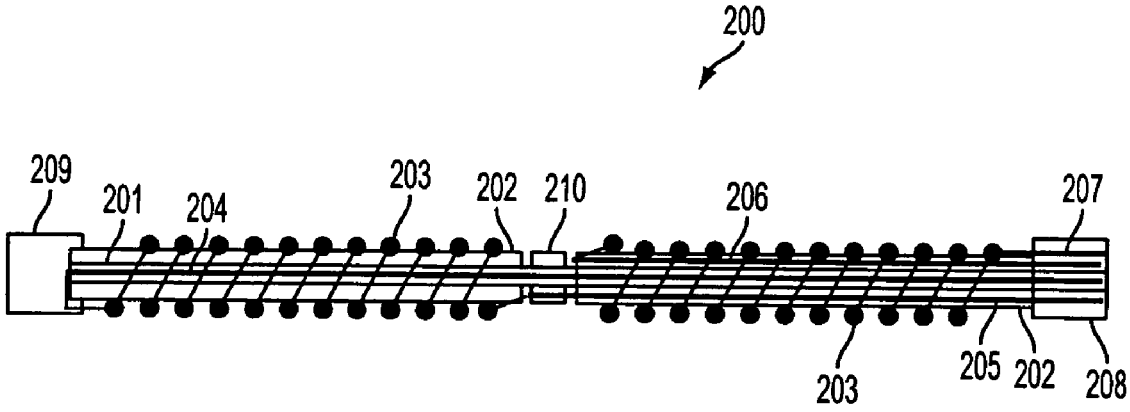
FIG. 6 is an exemplary diagram of a second heater element that may be used in the second oven-style heater system.

FIG. 6 is an exemplary diagram of a second heater element that may be used in the heater system 100 shown in FIG. 5. As shown in FIG. 6, the heater element 200 may be formed by using support structures such as tubes 201 and 202. The tubes 201 and 202 may be composed of quartz. The tube 201 may have a smaller diameter than the tube 202. Although the tubes 201 and 202 in FIG. 6 are shown arranged coaxially, the heater element 200 may be formed to include a single ended device for two separate heater channels. Heater coils 203 may be formed external to the larger tube 202. An electrical line 204 is formed for the left channel and passes through the center of the smaller tube 201. The return electrical line 205 for the left channel passes between the outer diameter of the smaller tube 201 and the inner diameter of the larger tube 202.

The same pathway can be utilized for the return electrical line 206 of the right channel. The hot electrical line 207 of the right channel can be external to the tubes. The four electrical lines 204-207 may be terminated at an end connector 208 located on one side of the heater element 200. The other end of the heater element 200 may include an optional mechanical connector 209 to help guide the heater element 200 into position so that it is properly seated into a mount. The end connectors 208 and 209 may be composed of a ceramic material to maintain the thermal integrity of the heater system 100. The heater element 200 in FIG. 6 may include a spacer 210 that ensures that the two channels do not interfere with each other.

Figure 7A:
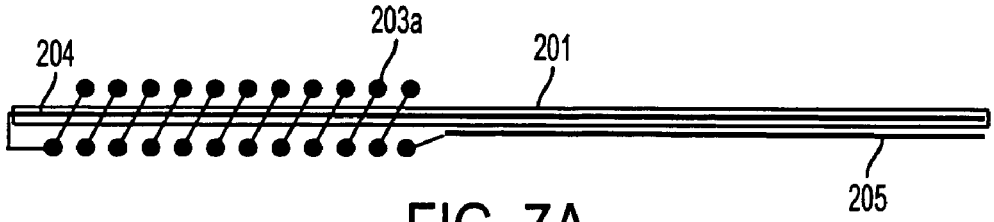
FIGS. 7A-E are exemplary diagrams of a method for forming the heater element in FIG. 6.
Figure 7B:
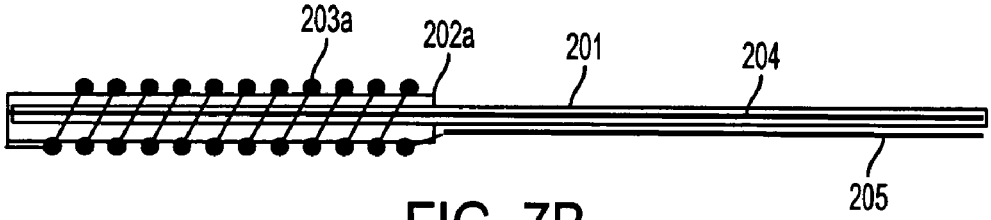
Figure 7C:
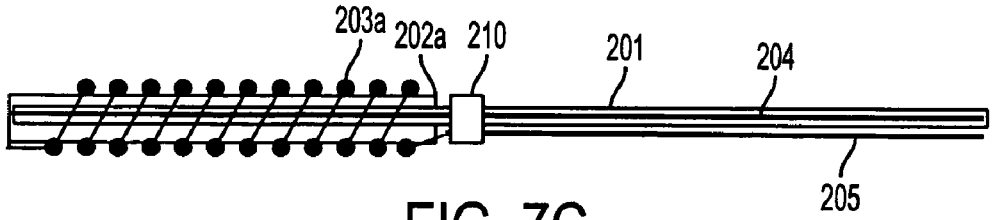
Figure 7D:
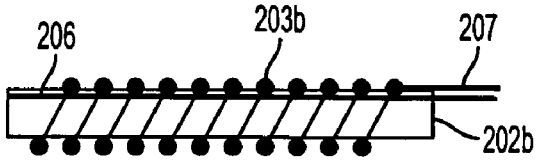
Figure 7E:
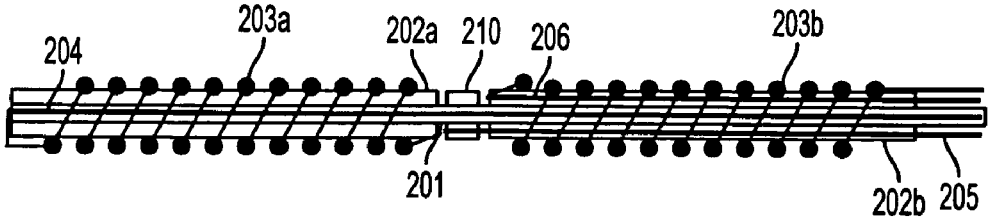

FIGS. 7A-E are exemplary diagrams of a method for forming the heater element in FIG. 6. As shown in FIG. 7A, the electrical line 204 of the left coil 203*a* may be inserted down the support structure, small tube 201. Then, as shown in FIG. 7B, the support structure, large tube 202*a* for the left hand side may be inserted over the small tube 201 and slipped into the coil 203*a*. As shown in FIG. 7C, the spacer segment 210 may then be slipped over the small tube 201 and the electrical line 205. As shown in FIG. 7D, the electrical line 206 on the right coil 203*b* may be inserted down another support structure, large tube 202*b*. The configuration may then be inserted over both the small tube 201 and the electrical line 205, as shown in FIG. 7E. At least one of the end connectors 208 and 209 may be fastened into place with the leads terminating in a pin or flat blade style connector so that the electrical lines 204-207 terminate in one of the end connectors. The end connector with the terminal lines may then be connected to a power source. The end connector may then provide structural integrity for the heating system 100, and act as an electrical connector. The end connectors 208 and 209 may be fastened, for example, with an adhesive.

The heater element 200 shown in FIGS. 6 and 7A-E may be easily removed via access through an opening, such as the endbell spoke area of the drum, if the heater element 200 fails to operate. A port at the end of the heater system may allow a service representative to remove the electrically disconnected heater element and replace it with a new one without removal and replacement of the entire imaging drum assembly. When replacing a long heater element, a tool may be used so that it is not necessary to search for the mounting features at the far/blind end of the heater system 100.

A drum that includes the oven-type heater system and has one or more heater element channels controlled from an electrical cable may be used for heating the interior of an imaging drum. The drum heater may have one or more primary heater channels and each of these heater channels may be separated into two or more sub-channels. The primary heater channels may be used to selectively apply heat to different regions of the drum. For example, the heater systems 100 (FIG. 5) and 400 (FIG. 2) may have a right and left channel to help with gradient control during periods when heavy printing is done primarily at one end of the drum or the other. Multiple channels may also aid in reducing flicker to acceptable levels.

Heat sensing devices, such as thermistors, may be located at each end of the drum to sense the temperature. The sensed temperature can then be sent to a controller that is coupled to the two heater channels, and the controller may adjust the average power delivered to the heaters. Further, when one of the thermistors senses that one or both ends of the drum are overheating, a fan may be turned on for cooling to heating system. The cooling air may cool the entire drum even if portions of the drum are not overheated. In this situation, the heater element on the end of the drum that is not overheated may have to turn-on to compensate for the cooling.

The heater systems 100 and 400 discussed above may include two 600 W channels. This configuration allows a relatively fast warm up rate while reducing flicker problems to an acceptable level. Each primary channel may include two sub-channels. These sub-channels may be run either separately, such as in the case of unequal resistance sub-channels or they can be combined in series or parallel, such as in the case of equal resistance sub-channels, to enable operation from 87-265VAC. The series configuration may be used when energizing the heaters with 230VAC, while the parallel case is for 115VAC. Each sub-channel may be equal resistance and rated at 300 W. It should be understood that primary channels composed of more than two sub-channels are also possible without departing from the spirit and scope.

As described above, each primary drum heater channel may have two separate heater sub-channels. The two separate heater sub-channels may allow two operating modes. For example, the two element wires may be operated in parallel at 115 V (Mode 1) and in series at 230 V (Mode 2). The switching mechanism used can be a double pole/double throw relay, which receives a switching signal from the printer electronics. Mode 1 may provide 600 watts per primary channel at 115 V and can operate in lower line voltage countries like the United States and Japan. Mode 2 may provide 600 watts per channel at 230 V and may operate in higher line voltage counties like Europe and Australia.

The heater systems 100 and 400 discussed above may be configured to include two independent element wires per primary channel. One of the wires may be used solely for the 115V operation, and the other wire may be used solely for the 230V operation. With this configuration, a 230V heater system may be used in the 115V environment as a sustaining heater that is more suited for lower power levels and reduces flicker. This configuration allows three useable heat fluxes per primary channel from only two physical heater elements. In a series/parallel structure, the element wires themselves may be the same diameter and same length to simplify the structure. Elements wires that are the same size may provide more reliability. Furthermore, the series/parallel structure may result in two equal sized wires of an intermediate diameter or include one wire that is larger in diameter (and stronger) than another wire that is smaller in diameter (and much weaker) than the larger wire.

Mode 1 can include a nominal 115V electrical line that may be used for all low voltage operation between 87V to 132V. Mode 2 can include a nominal 230V electrical line that will be used for all high voltage operation (198V to 265V). Thus, both Mode 1 and Mode 2 may provide 600-watts per primary channel. When utilizing two channels a total of 1200 watts of power could be available to heat the drum during warm-up from cold start. It should be understood that the numerical values are representative only. Table 1 below shows an example of current, voltage, and resistance that may be used for Modes 1 and 2:

TABLE 1

| | Mode 1 Low Voltage Heater | Mode 2 High Voltage Heater |
|---|---|---|
| Design Voltage | 115 V | 230 V |
| Current | 5.2 Amps | 2.5 Amps |
| Equivalent Resistance | 22.04 Ohms | 88.17 Ohms |

In various exemplary embodiments, an entire printing system may be configured to operate at any line voltage that might be encountered. For example, the printing system may be configured with an auto-switching power supply that works between 87V (low line in Japan) and 265V (high line in Europe and Australia), and automatically detects an applied line voltage. While the printing system may be configured to operate at this voltage range for extended periods of time (up to the entire life of the printer), the heater systems in the printing systems do not have to operate at this voltage range. Although the drum heating system may be connected to the line voltage, the RMS voltage at the heater systems may be reduced through "AC Cycle Dropping." This configuration can keep the heater systems at or below their rated power (on average) regardless of the line voltage. Thus, each of the 600-watt channels may only see a maximum of 600-watts regardless of the operating line voltage of the printing system.

The use of AC power line voltage to provide controlled power in a printing system can be very cost effective because it can be applied directly to the loads without any conversion, and there is a large power capacity. In some color printer printing systems, large power demands may add to overall product cost if DC power were used instead of AC power. Thus, the controlled AC power may be an alternative because, by using a "zero crossing detector," a triac may be used to control how many line cycles are passed to the load (heater). For example, in Mode 1 (the 115V channel), all cycles may be allowed to pass if the line voltage is 115VAC. If the line voltage is 140VAC, then only a portion of the cycles may be allowed to pass to the load. A 100-ohm heater system at a line voltage of 100 volts may draw 1 amp and produce 100 watts with all cycles operating.

At 140 volts, the same heater system may draw 1.4 amps and provide 196 watts instantaneously. However, this heater system may be turned-on only about 1 out of 2 cycles, resulting in the average power to the heater being only 100 watts. By controlling a portion of the cycles to the heater system, the power system may use the same effective power under any line voltage. Therefore, heater elements and triacs may be configured to take the peak transient currents and watts up to high line voltage, but not peak steady-state currents and wattages.

The resistance and power of the heater elements in the printing systems may be specified at some nominal voltage depending on the requirements of the heater. For example, the voltage may be either 115V or 230V. High line voltage is defined approximately at 10% higher than the standard line voltage. For example, electronic devices in the United States operate at 120V and high line voltage would be defined as about 132V. The heater systems may operate in both an 115V mode and a 230V mode so that the maximum voltage each mode will see is the high line voltage for each of their ranges. The 115V line should see no more than 132VAC peak RMS voltage, while the 230V line should see not more 264 peak RMS voltage. Any voltage less than 115V or less than 230V for Mode 1 and Mode 2, respectively, may result in all cycles being sent to the heater system. As the voltage is increased above 115V or 230V line voltage (up to 132V or 264V), cycle-dropping may reduce the number of cycles to the printing system resulting in wattage equivalent to that at 115V or 230V, respectively.

The heater systems discussed above are very reliable. Thus, the heater systems can be used in imaging systems, for example, that are a high duty cycle network printer, have a service life of between 300,000 to 3 million prints and expect to remain in use for up to 5 years. The use of multiple heater channels in serial and/or parallel operation may reduce flicker, decrease warm-up time and increase reliability because of the heater systems may operate at their rated wattage rather than at higher wattages for short intervals. The multiple heater channels may reduce thermal/mechanical stress caused by repeated warm-ups and cycle dropping.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A heating system, comprising:

a heater box that is positioned inside an imaging drum having an axis and arranged asymmetrically about the axis of the imaging drum, the heater box includes an open side facing an internal drum surface; and at least one heater element positioned in the heater box, the at least one heater element further comprising:

first and second support structures that are disposed on a central support structure, the first support structure having an end connector at one side away from the second support structure;

a first coil formed around the first support structure; and a second coil formed around the second support structure, one end of the second coil being coupled by an electrical line that extends within the central support structure through the second support structure towards the end connector.

2. The heating system of claim 1, wherein the first and second support structures are generally tubular and coaxial.

3. The heating system of claim 2, wherein the first and second support structures are formed of a refractory material.

4. The heating system of claim 2, wherein the electrical line connecting the one end of the second coil extends within the central support structure through both the first and second support structures.

5. The heating system of claim 1, the at least one heater element further comprising a spacer disposed on the central support structure and located between the first support structure and the second support structure.

6. The heating system of claim 1, wherein the end connector includes an outlet having terminal pins or blades.

7. The heating system of claim 1, the at least one heater element further comprising:

a support structure;

an heating element coiled around a portion of the support structure; and electrical terminals positioned at ends of the support structure that each include a fastener that is coupled to the support structure by dead turns of the coiled heating element.

8. The heating system of claim 7, the support structure being made of a refractory material and having at least one of a generally cylindrical or rectilinear shape.

9. The heating system of claim 8, the heating element being wound in a coil around at least a portion of a periphery of the support structure.

10. The heating system of claim 7, wherein the fasteners are at least one of crimps having U-shaped ends that are crimped and U-shaped ends that are welded, to be in contact with the coil through an extension of the electrical terminals.

11. The heating system of claim 7, further including a gap formed between the terminals and the ends of the support structure.

12. A printing system that includes the heating system of claim 1, wherein the heating system is controlled to independently heat at least two different portions of the imaging drum.

13. The heating system of claim 1, wherein the heater box is composed of a refractory material.

14. The heating system of claim 1, wherein the heater box is composed of a reflective material.

15. The heating system of claim 1, wherein the heater box is composed of a combination of a refractory material and a reflective material.

16. The heating system of claim 1, wherein the heater box includes an outer portion that is composed of a refractory material and an inner portion that is composed of a reflective material.

17. The heating system of claim 1, wherein the at least one heater element further includes a coil that is at least partially surrounded by a refractory material.

18. The heater system of claim 1, further comprising:

a plurality of heater elements positioned inside the heater box;

at least two heater circuits;

at least two channels; and a relay switch that operates to switch the heater circuits between a series or parallel configuration to operate the plurality of heater elements.

19. The heater system of claim 18, wherein each of the at least two channels are divided into two sub-channels used to independently control heating on different portions of the imaging drum.

20. The heater system of claim 19, wherein the at least two channels control heating on left and right sides of the drum, and the at least two channels are independently controlled to provide a uniform temperature profile across a surface of the drum.

21. The heater system of claim 18, wherein the relay switch also controls two operating modes for the heater system, the first mode operating at approximately 115 volts and the second mode operating at approximately 230 volts.

22. A heating element, comprising:

first and second support structures that are disposed on a central support structure, the first support structure having an end connector at one side away from the second support structure;

a cross piece having an axis and supporting the first support structure, the second support structure, and the central support structure so that the first support structure, the second support structure, and the central support structure are arranged asymmetrically about the axis of the cross piece;

a first coil formed around the first support structure; and a second coil formed around the second support structure, one end of the second coil being coupled by an electrical line that extends within the central support structure through the second support structure towards the end connector.

23. The heating element of claim 22, wherein the first and second support structures are generally tubular and coaxial.

24. The heating element of claim 23, wherein the first and second support structures are formed of a refractory material.

25. The heating element of claim 23, wherein the electrical line connecting the one end of the second coil extends within the central support structure through both the first and second structures.

26. The heating element of claim 22, the at least one heater element further comprising a spacer disposed on the central support structure and located between the first support structure and the second support structure.

27. The heating element of claim 22, wherein the end connector includes an outlet having terminal pins or blades.

* * * * *